United States Patent [19]

Sumner

[11] Patent Number: 4,716,832

[45] Date of Patent: Jan. 5, 1988

[54] HIGH TEMPERATURE HIGH PRESSURE DETONATOR

[75] Inventor: Cyril R. Sumner, Houston, Tex.

[73] Assignee: Halliburton Company, Duncan, Okla.

[21] Appl. No.: 908,742

[22] Filed: Sep. 18, 1986

[51] Int. Cl.[4] ..... C06C 7/00

[52] U.S. Cl. ..... 102/275.6; 102/275.1; 102/275.12

[58] Field of Search ..... 102/275.1, 275.2, 275.4, 102/275.5, 275.6, 275.8, 275.7, 275.11, 275.12, 701; 89/1.15

[56] References Cited

U.S. PATENT DOCUMENTS

| | | | |
|---|---|---|---|
| 2,923,239 | 2/1960 | Andrew et al. | 102/275.4 |
| 3,628,455 | 12/1971 | Nelson | 102/275.8 X |
| 3,713,384 | 1/1973 | Turnbull | 102/275.5 |
| 3,734,019 | 5/1973 | Rentz et al. | 102/275.6 |
| 3,991,679 | 11/1976 | Savitt et al. | 102/275.4 |
| 4,206,706 | 6/1980 | Steele | 102/275.7 |
| 4,542,695 | 9/1985 | Betts et al. | 102/275.1 X |
| 4,649,822 | 3/1987 | Seeman | 102/275.1 |

*Primary Examiner*—David H. Brown

*Attorney, Agent, or Firm*—William J. Beard

[57] ABSTRACT

For use in a perforating gun assembly typically lowered on an electric wireline or on tubing into a wellbore exposed to high pressure and high temperature, an apparatus is set forth which includes an elongate cylindrical housing cooperative with detonating cord. It has a side port or window to enable the detonating cord to be folded slightly into it. The housing includes a cavity for receiving required explosives and connection with an ignitor. This arrangement enables the housing to connect with the detonating cord and overcome high pressure or high temperature difficulties. This will accommodate detonating cords of different sizes and shapes and with differing types of covering materials.

8 Claims, 7 Drawing Figures

FIG. 1
(PRIOR ART)
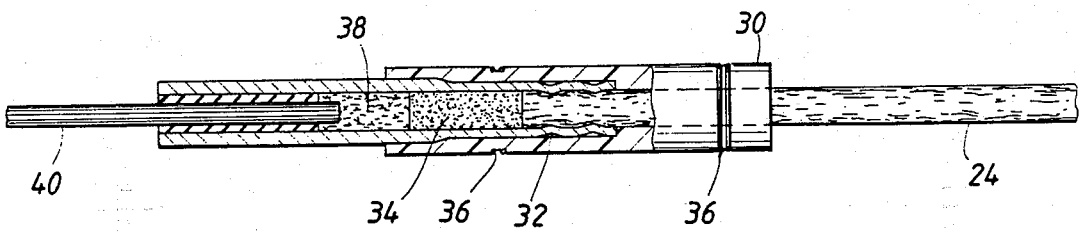
FIG. 2
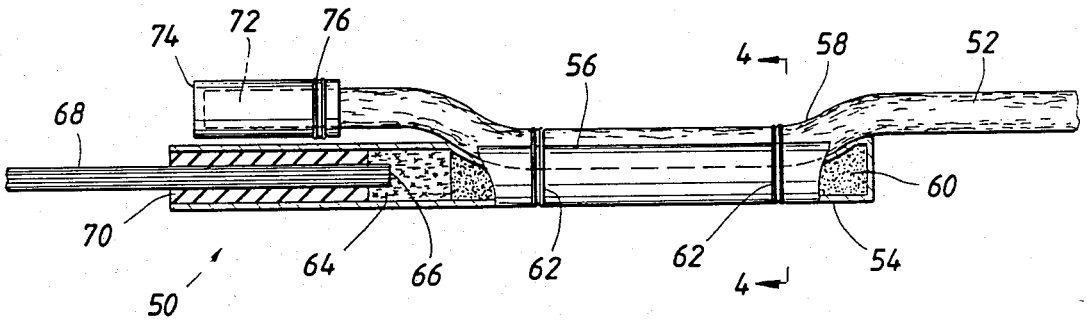
FIG. 3
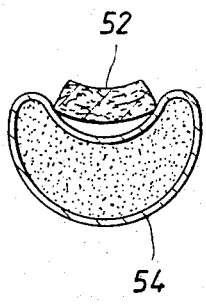
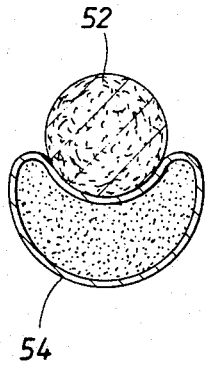
FIG. 4

FIG. 5
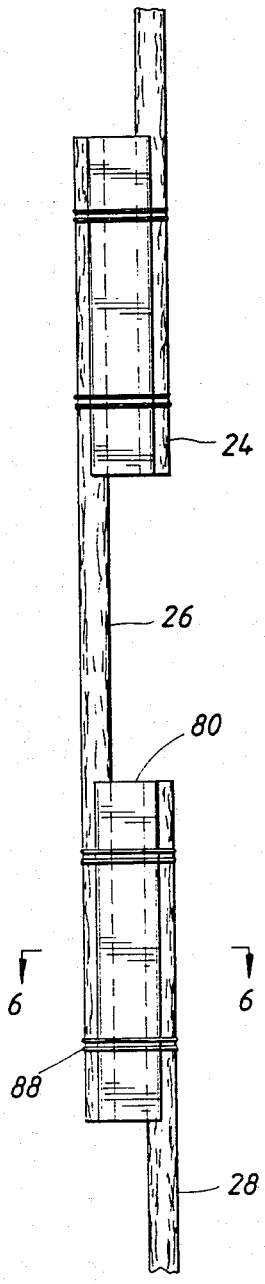
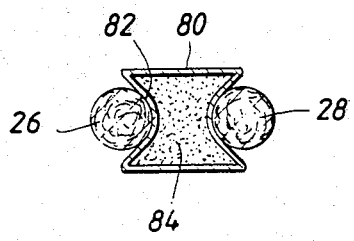
FIG. 6
FIG. 7
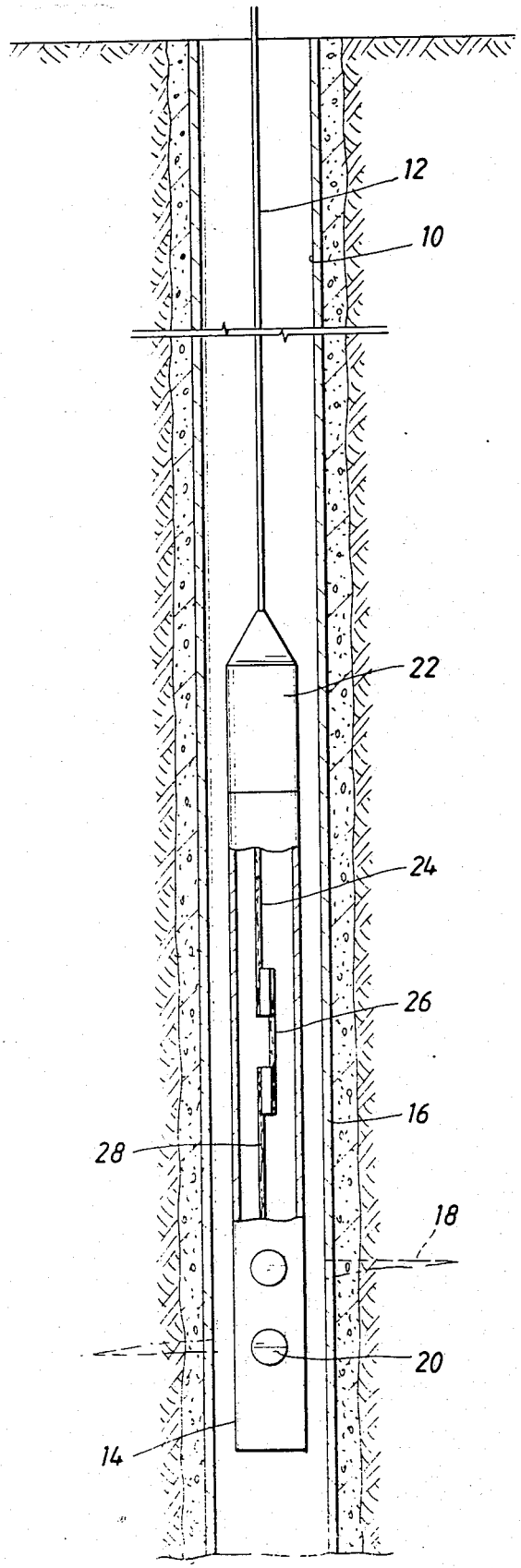

HIGH TEMPERATURE HIGH PRESSURE DETONATOR

BACKGROUND OF THE DISCLOSURE

This disclosure is directed to a high pressure high temperature detonator system particularly adapted to be used in a perforating gun assembly. In drilling a deep well in seeking petroleum reserves, the well often becomes so deep that it is exposed to extremely high pressures and temperatures. The ambient temperature can be as high as 500° F. and the pressure can be as high as 25,000 psi. Generally, the conditions become more severe as the well becomes deeper. As deeper and deeper wells are drilled, the prevailing conditions are so severe that safe detonation becomes a problem.

A perforating gun is typically an elongate tubular body which supports one or more shaped charges. The carrier which supports the shaped charges typically must include a type of detonator, detonator cord, and connections to several shaped charges. Normally, this assembly is lowered into a well by means of an electric wireline. Sometimes, it can be lowered into a well on a tubing string. The perforating gun assembly is lowered to the required depth. It is fired by providing an electric current to the detonator ignitor which starts detonation along the detonating cord. Alternatively, a dropped weight may trigger firing in a tubing conveyed perforating gun assembly. In either case, it is necessary for the detonation to proceed along the detonating cord to all the shaped charges for detonation in sequence. There are usually many shaped charges in such as assembly. While it is possible to have only a single charge, they are normally connected in series somewhat in the fashion of a series of Christmas tree lights. In similar fashion, they all must operate to assure proper detonation.

In the event the detonating cord fails at some mid point of an assembly supporting N shaped charges, then the first several shaped charges may properly detonate, but the remaining shaped charges will not. This divides the N shaped charges in the two groups, those which are properly detonated and those which do not detonate as a result of failure. This creates a very dangerous condition for retrieval of the assembly. Namely, it is dangerous because there are live shaped charges remaining in the assembly when it is pulled out of the well. They can possibly detonate at the wrong elevation, and even worse, they can detonate at the top of the well, risking injury to personnel. All of these factors amply illustrate why it is essential that the entire string of shaped charges detonate in proper sequence. If they do not, the risk is significant both to personnel and equipment, and proper and safe execution of any remedial operations is very difficult.

One of the factors which increases the risk of failure is increasing temperature and pressure. Excessive pressure and temperature prevailing in a deep well act on the detonating cord to create problems which result in a high failure rate. Failures occur for a multitude of reasons. The detonator cord must connect with various detonators. In the presence of exceedingly high pressures and temperatures, the pressure may force fluid into the detonator and the protective boot which is attached to the detonator cord. This may cause a malfunction and thereby abort the detonation of the N shaped charges. Moreover, pressure may force the detonator cord, compressing the cord and explosive in the detonator housing, to alter the required position of the ignitor versus the ignition mix thereby impede proper firing or to cause poor firing.

With these problems in view, the present apparatus is a high pressure, high temperature detonator cord assembly which is particularly useful in high pressure high temperature wells. Moreover, the present apparatus can be installed with various detonator assemblies including a conventional bridge wire, exploding bridge wire, exploding foil initiator, percussion type initiator, and pressure actuated initiators. The apparatus incorporates a housing of sufficient wall thickness to withstand prevailing pressures. The appropriate primary explosive mix detonating cord and other components for operation are thus protected within the housing. More will be noted concerning this in detail hereinafter.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a sectional view through a detonating cord assembly in accordance with the teaching of the prior art;

FIG. 2 is a sectional view through the improved high pressure high temperature detonator assembly of the present disclosure;

FIG. 3 is a sectional view along the line 4—4 of FIG. 2 showing cooperation with a round detonator cord;

FIG. 3 is an alternate view to the arrangement of FIG. 4 showing cooperation with a flat or rectangular detonator cord;

FIG. 5 shows upper and lower detonating cords which overlap one another and which are adjacent to a focused explosive connector in accordance with the teachings of this disclosure;

FIG. 6 is a sectional view along the line 6—6 of FIG. 5 showing additional details of construction; and FIG. 7 shows a perforating gun assembly in a well with a portion thereof broken away to show the arrangement of the detonating cord therein.

DETAILED DESCRIPTION OF THE PREFERRED EMBODIMENT

Attention is first directed to FIG. 7 of the drawings. There, a very deep well is illustrated and identified by the numeral 10. An electric wireline 12 supports a perforating gun assembly 14 in the well. It is intended to form perforations through the casing 16 and form a deep hole at 18 indicated in dotted line. Normally, the perforating gun assembly 14 supports several shaped charges 20, therebeing N shaped charges deployed along the length of the assembly 14. At the top end of the assembly, the electric wireline 14 connects with a detonator ignitor 22 which detonates the N shaped charges in sequence. This occurs through the detonating cord 24. As shown in the portion of the tool broken away, the cord 24 includes a first or upper segment which connects with a second segment 26 which in turn connects with a third segment 28 and so on. The several segments extend the length of the assembly to ignite the several shaped charges. The system shown at FIG. 7 may well be exposed to pressures as high as 25,000 psi and ambient temperatures in the range of 500° F. which severe conditions prevent proper operation.

Going now to FIG. 1, a prior art device will be discussed. The detonator cord 24 is shown in FIG. 1 to extend into a seal boot 30. It has an internal, hollow, axial passage and suitable crimps are formed at 32. The crimps 32 are formed by crimping the shell around the detonating cord 24. Typically, more than one crimp is formed, normally there being two or three. The cord is butted against a secondary mix detonator 34. Typically, a tie cord 36 around the exterior is pulled snug to create a clamping action on the sealed boot 36 on the detonating cord 24 and on the secondary mix detonator 34. The secondary mix detonator 34 is immediately adjacent to a primary mix detonator 38. A bridge wire ignitor 40 extends into the primary mix detonator 38. The ignition of the apparatus of FIG. 1 proceeds from left to right. A current is applied to bridge wire detonator 40 which detonates primary mix 38. Primary mix 38, in turn, detonates secondary mix 34 which, in turn, sets off the detonating cord 24. Detonating cord 24 extends to and detonates the individual shaped charges.

The structure of FIG. 1 is susceptible to damage by high pressure and high temperature. As an example, it is hard to sustain internal pressure isolation by means of the tie string 36 and cooperative crimps 32.

The improved apparatus of the present disclosure is identified generally by the numeral 50 in FIG. 2 of the drawings. There, a detonator cord 52 of typical gauge and cross section connects with the apparatus 50. By way of background, the detonating cord 52 can have different sizes, shapes, and coverings. Without exhausting the possibilities, it can be round, rectangular, ribbon shaped or square. Typical coverings include plastic, silicon rubber, sheet metal such as aluminum or lead, plastic coating such as Teflon (a trademark of the DuPont Company) and other surface coating materials capable withstanding the typical circumstances encountered in the use of the detonating cord 52. The numeral 54 identifies an enclosure housing. It is typically a a hollow structure elongate in shape and cylindrical with focussing cavity 56 extending longitudinally along one side thereof. The focussing cavity 56 is dished inward to enable the detonating cord to be bent at 58, and a portion of it extends into the cavity 56 in the side of the cylindrical housing 54. The dished form of the focusing cavity 56 is shaped that when the ignitor charge 64 is detonated explosive force is focused onto the detonating cord 52 along the entire length of focussing cavity 56. The wall of the housing 54 is sufficiently thick to resist ambient pressure. The housing is normally tubular material, metal being preferred, sufficiently thick to withstand ambient pressure. The housing is closed except the end opening and that is plugged, as will be described. On the interior, a powder charge 60 is positioned immediately adjacent to the detonating cord. The cord is then tied in position by means of tie cords 62. One or more can be located around the housing and several tie or bind the cord 52 so that it cannot escape. Moreover, the tie cords are spaced apart from one another so that they hold the full length of the cord adjacent to the window in the fashion illustrated in FIG. 2.

A significant length of the housing 54 is filled with the powder 60. The housing extends further to enclose a primary explosive mix 64. This is located at the immediate end of the powder. Moreover, the termination of the ignitor 68 is exposed in this region to be ignited. The end 66 is a part of the ignitor 68 which extends elsewhere. It is surrounded by a seal element 70. The seal 70 is inserted into the end of the housing. It locks the ignitor 68 in place and provides a firm anchor for it. It secures the end 66 in sufficient proximity for ignition. Moreover, it permits the powder charge 60 to explode with the primary explosive mix 64 which is contiguous and thereby provides a rapid fire for ignition of all the components.

The detonating cord 52 terminates at an end portion 72. A seal cap 74 is positioned around the end of the detonating cord. Moreover, it is fastened in position with a tie cord 76. Alternatively, it can be crimped and thereby form additional means of securing the end cap 74 around the end. The end cap preferably has an internal axial passage profiled to match the construction of the cord. As will be understood, the cord 52 may end in the fashion shown in FIG. 2 or it may extend past the equipment of FIG. 2 and connect to additional components. This permits the cord 52 to be used in long or short lengths. In FIGS. 3 and 4 of the drawings, it will be observed that the housing 54 surrounds a significant portion of the cord 52. The embodiment shown in FIG. 3 is a flat or ribbon type cord. An alternate arrangement is shown in FIG. 4 where the cord is circular. In either case, the cross sectional shape of the cord can be accommodated without difficulty.

The housing 54 can be installed at multiple locations along the perforating gun assembly. This permits as many as are required. Moreover, the housing serves as a type of focusing device for explosions. The explosive energy occurring on detonation is focused or directed. This enables reliable detonation of practically all sizes and shapes of shaped charges cooperative with all types and sizes of detonating cords, all this occurring without regard to the type of cover or sleeve on the detonating cord 52. Moreover, this would appear to eliminate problems temporarily solved by detonator seals connecting with the cord. Such seals inevitably fail to operate well in the rugged environmental circumstances encountered by this apparatus. this permits, therefore, the detonation of a great variety of explosive shapes in a wide range of temperatures and pressures. Likewise, it seems to avoid the unwanted pumping or piston action where the detonating cord is pushed relative to fixed structures which support the cord 52.

Attention is now directed to an alternate embodiment shown in FIG. 5 of the drawings. There, the numerals 24, 26, and 28 identify separate segments of detonating cord which are joined together. To consider this in detail, the numeral 80 identifies a housing best shown in end view in FIG. 6. It has parallel side walls and curving edges at 82 at the end walls. The side walls are dished to conform and enable the cords to conform to the adjacent housing. This enables adjacent parallel spaced lengths of detonating cord to be positioned adjacent the housing. That is, FIGS. 5 and 6 together show an arrangement whereby the detonating cords 26 and 28 overlap one another and are spaced at opposite sides of the housing in duplicate conforming dished cavities. So to speak, the housing is a hollow rectangular box. A cross sectional cut along the length of the housing shows a rectangle. The end plates are curved at 82. The interior of the housing is filled with explosive powder at 84. Suitable tie cords 88 wrap around and pull both detonating cords into the housing, thereby securing a tight and fast arrangement whereby the powder on the interior is unable to escape.

At the time the apparatus shown in FIG. 5 is used, ignited detonating cord conducts an explosive fire front along the cord. When it encounters the connector 80, the explosive first traverses the housing from one cord segment to the other.

The embodiment shown in FIG. 5 can be exposed to extremely high pressures and temperatures. Housing leaks are very unlikely. A focused explosion transfers the explosion across the housing from top to bottom or bottom to top depending on which segment is ignited first. This transfers the explosion so that it can continue along the detonating cord segments. If desired, any of the detonator cord segments can be extended so that there are two or more explosion train assemblies coupled together by means of the housing 80.

Going back to the apparatus shown in FIG. 2, it will be observed that a common tie cord is used similar to that shown in FIG. 5. Again, leakage or defective sealing in view of the extremely high pressure and temperatures poses no particular problem. The device operates successfully to transfer the explosive between the detonating cord 52 and the ignitor means 68. Optionally, the detonating cord can be extended to additional shaped charges. On the other hand, the end cap 74 shown can also be used at the termination of the detonating cord.

In the preferred embodiment, the gauge of the housing 54 is sufficient to withstand the pressures and temperatures of the deep well. A lightweight gauge can be used in some instances, but the structure is preferably made of a relatively high quality steel. The tie straps can typically be plastic cord.

While the foregoing is directed to the preferred embodiment, the scope thereof is determined by the claims which follow.

What is claimed is:

1. For use in a perforating gun assembly having a detonating cord therein and subject to use in deep well conditions, an apparatus comprising an elongate housing member having at least one external focussing cavity shaped therein, said housing member being hollow and shaped such that said detonating cord is received into said external focussing cavity; said hollow portion of said housing member being interior to and adjacent to and extending along said at least one focussing cavity and shaped for receiving a cooperative ignitor means and an explosive mixture in said hollow portion of said housing member and coupled to said ignitor for providing ignition of said explosive mixture.

2. The apparatus of claim 1 wherein said housing is an elongate cylinder having two spaced ends, seal means insertable into a first end for sealing said first end to enable said ignitor means to extend exteriorly therefrom, the opposite end being closed, and said focusing cavity having a width and length sufficient to enable a portion of said detonating cord to fold partially but not wholly into said focussing cavity.

3. The apparatus of claim 2 wherein said housing member and said detonating cord join to permit a tie string to encircle said housing member for joining said housing to said cord.

4. The apparatus of claim 2 wherein said explosive mix comprises a primary explosive in said housing adjacent to said ignitor means and a powder adjacent longitudinally to said primary explosive.

5. The apparatus of claim 2 further including a separate end cap affixed to an end of said detonating cord.

6. The apparatus of claim 2 wherein said housing member has plural parallel side walls along the entire length thereof between two ends on said housing member and has plural external focussing cavities, said ends and said plural parallel side walls defining said plural focussing cavities therebetween.

7. The apparatus of claim 6 wherein said housing member includes at least first and second parallel external focussing cavities, said cavities having sufficient length to enable both to receive detonating cord therein.

8. The apparatus of claim 7 wherein said first and second cavities are diametrically on opposite portions of said housing.

* * * * *